US010246281B2

(12) United States Patent
Kuriki

(10) Patent No.: US 10,246,281 B2
(45) Date of Patent: Apr. 2, 2019

(54) SHEET CONVEYING APPARATUS

(71) Applicant: Brother Kogyo Kabushiki Kaisha, Nagoya (JP)

(72) Inventor: Yuichiro Kuriki, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 15/693,604

(22) Filed: Sep. 1, 2017

(65) Prior Publication Data

US 2018/0118480 A1 May 3, 2018

(30) Foreign Application Priority Data

Oct. 27, 2016 (JP) ..... 2016-211061

(51) Int. Cl.
*B65H 3/06* (2006.01)
*B65H 7/18* (2006.01)
*B65H 3/34* (2006.01)

(52) U.S. Cl.
CPC ..... *B65H 3/0661* (2013.01); *B65H 3/063* (2013.01); *B65H 3/0653* (2013.01); *B65H 3/0669* (2013.01); *B65H 3/34* (2013.01); *B65H 7/18* (2013.01); *B65H 2404/725* (2013.01); *B65H 2801/39* (2013.01)

(58) Field of Classification Search
CPC ..... B65H 3/34
USPC ..... 271/121, 117
See application file for complete search history.

(56) References Cited

U.S. PATENT DOCUMENTS 6,017,031 A * 1/2000 Oosawa ..... B65H 3/56 271/10.09
8,985,570 B1 * 3/2015 Fang ..... B65H 1/04 271/121
9,592,974 B2 * 3/2017 Saito ..... B65H 3/0669
2007/0063421 A1 * 3/2007 Demmeler ..... B65H 3/06 271/121
2008/0203652 A1 * 8/2008 Yasukawa ..... B65H 3/063 271/117
2017/0107068 A1 * 4/2017 Kanamitsu ..... B65H 1/025
2017/0126912 A1 * 5/2017 Shuto ..... B65H 3/063

FOREIGN PATENT DOCUMENTS

JP 4820314 B 11/2011
JP 5830694 B 12/2015

* cited by examiner

*Primary Examiner* — Patrick Cicchino
(74) *Attorney, Agent, or Firm* — Burr & Brown, PLLC

(57) ABSTRACT

A sheet conveying apparatus includes: a supporter having a support surface; a supplier including a supply roller rotatable about a rotation axis; a separator for separating sheets; a stopper pivotable about a first axis and movable between a first position at which a distal end portion of the stopper intersects a conveyance path and a second position at which the distal end portion is separated from the support surface; and a stopper cam pivotable about a second axis and movable between a third position at which the stopper cam contacts the distal end portion at the first position and a fourth position at which the stopper cam is spaced apart from the distal end portion at the first position. The second axis is located upstream of the rotation axis of the supply roller and farther from the support surface than the rotation axis.

9 Claims, 9 Drawing Sheets

SHEET CONVEYING APPARATUS

CROSS REFERENCE TO RELATED APPLICATION

The present application claims priority from Japanese Patent Application No. 2016-211061, which was filed on Oct. 27, 2016, the disclosure of which is herein incorporated by reference in its entirety.

BACKGROUND

The following disclosure relates to a sheet conveying apparatus.

There is known a sheet supplying apparatus as one example of conventional sheet conveying apparatuses. This sheet supplying apparatus includes a chute, a set roller, a pressure roller, and a separating roller. The separating roller is generally called a retard roller.

The chute has an upper surface for supporting a sheet or sheets. The pressure roller presses the sheet supported on the upper surface of the chute, toward the set roller. The set roller is rotatable about a rotation shaft. The set roller is rotated while being in contact with the sheet supported on the upper surface of the chute, to convey the sheet to the downstream side in the conveying direction along the conveyance path. The separating roller is located downstream of the pressure roller in the conveying direction and opposes the set roller. In the case where a plurality of sheets are supplied, the sheets are separated one by one and conveyed by the set roller and the separating roller toward the downstream side in the conveying direction.

This sheet supplying apparatus further includes a flap and a set guide provided upstream of the separating roller in the conveying direction. The flap is supported so as to be pivotable about a rotation shaft that is located opposite to the rotation shaft of the set roller relative to the upper surface of the chute. The flap is movable between (i) a first position at which a distal end portion of the flap intersects the conveyance path to restrict movement of leading edges of the sheets supported on the upper surface of the chute and (ii) a second position at which the distal end portion does not intersect the conveyance path and is located more downstream in the conveying direction than at the first position. The set guide is supported so as to be pivotable about a rotation shaft that is located opposite to the rotation shaft of the flap relative to the upper surface of the chute. A small recess is formed in a downstream end portion of the set guide in the conveying direction. The set guide is movable between (a) a third position at which the set guide restricts movement of the flap to the second position by contact of the recess with the distal end portion of the flap located at the first position from a downstream side in the conveying direction and (b) a fourth position at which the set guide is spaced apart from the distal end portion of the flap located at the first position to allow movement of the flap to the second position.

SUMMARY

In the above-described sheet supplying apparatus, the rotation shaft of the set guide is located near the set roller and nearer to the upper surface of the chute than the rotation shaft of the set roller. That is, many components are disposed at a small space near the set roller and the separating roller, which limits a space for providing the set guide and a space for movement of the set guide from the third position to the fourth position. Thus, it is difficult for the recess of the set guide located at the third position to be in contact with the distal end portion of the flap located at the first position with a large amount. As a result, when a user places the sheets onto the upper surface of the chute, the distal end portion of the flap is easily separated from the recess of the set guide by a shock given to the flap due to contact of the leading edges of the sheets with the flap. If the distal end portion of the flap is separated from the recess, the flap cannot appropriately restrict movement of the leading edges of the sheets.

Accordingly, an aspect of the disclosure relates to a sheet conveying apparatus including a stopper capable of appropriately restricting movement of leading edges of sheets.

In one aspect of the disclosure, a sheet conveying apparatus includes: a supporter comprising a support surface configured to support a plurality of sheets; a supplier comprising a supply roller rotatable about a rotation axis, the supply roller comprising an outer circumferential surface partly exposed from the support surface and configured to supply one or more sheets supported by the support surface toward a downstream side in a conveying direction along a conveyance path by rotating in contact with the one or more sheets supported by the support surface in a direction for supplying the one or more sheets in the conveying direction; a separator disposed downstream of the supplier in the conveying direction and configured to separate one by one the one or more sheets supplied by the supplier and convey the separated sheet toward the downstream side in the conveying direction; a stopper disposed upstream of the separator in the conveying direction and pivotable about a first axis that is located opposite to the rotation axis of the supply roller relative to the support surface, the stopper being movable between (i) a first position at which a distal end portion of the stopper extends to the support surface and intersects the conveyance path to restrict movement of leading edges of the plurality of sheets supported by the support surface and (ii) a second position at which the distal end portion is separated from the support surface and is located more downstream in the conveying direction than at the first position; and a stopper cam disposed upstream of the separator in the conveying direction and pivotable about a second axis that is located opposite to the first axis relative to the support surface, the stopper cam being movable between (a) a third position at which the stopper cam contacts the distal end portion of the stopper located at the first position from a downstream side in the conveying direction to restrict movement of the stopper toward the second position and (b) a fourth position at which the stopper cam is spaced apart from the distal end portion of the stopper located at the first position to allow movement of the stopper toward the second position. The second axis is located upstream of the rotation axis of the supply roller in the conveying direction and farther from the support surface than the rotation axis.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described one embodiment by reference to the drawings.

Figure 1:
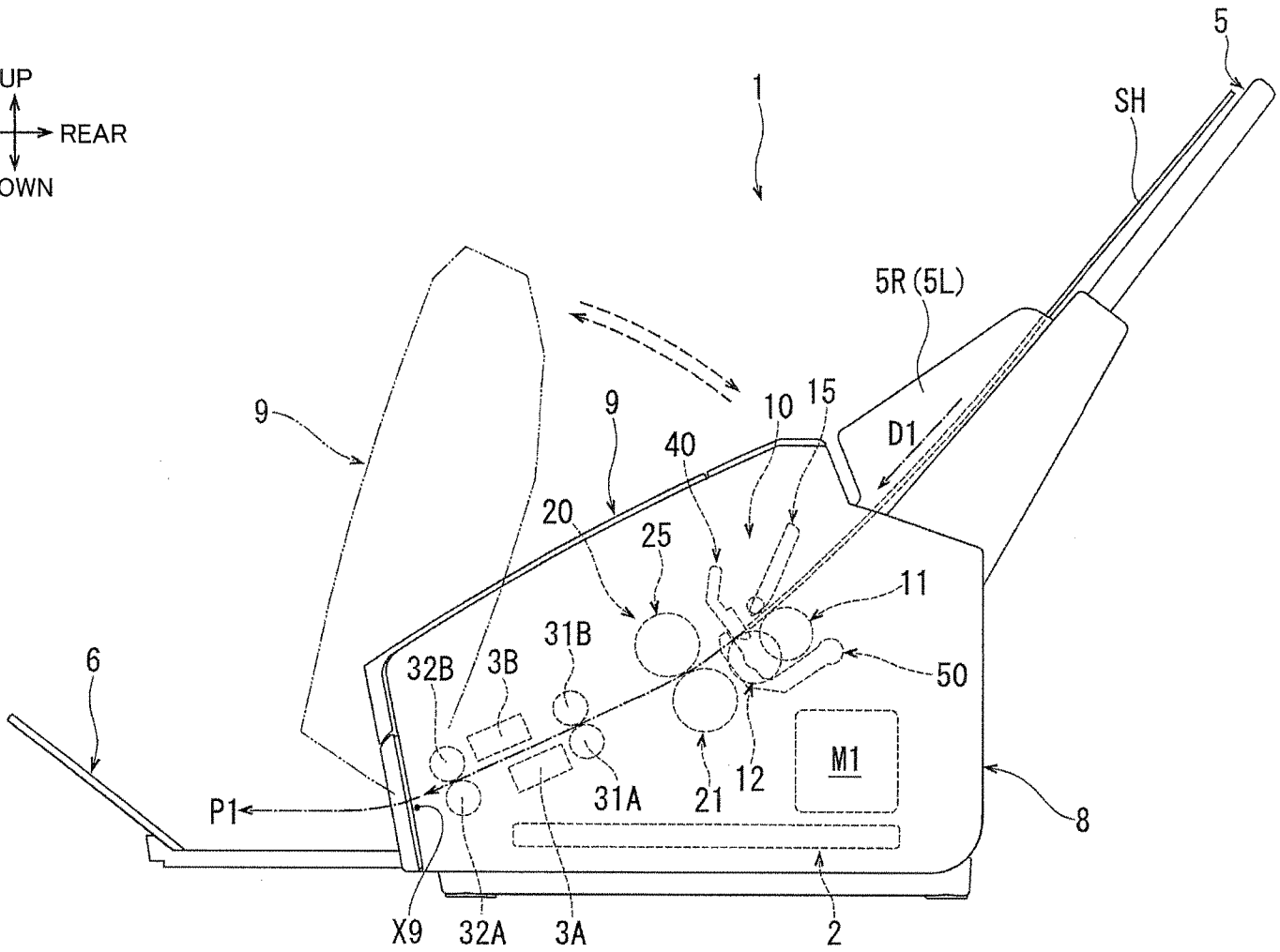
FIG. 1 is a schematic side view of an image reading apparatus according to one embodiment.

As illustrated in FIG. 1, an image reading apparatus 1 is one example of a sheet conveying apparatus. In FIG. 1, a side of the image reading apparatus 1 on which an output tray 6 is disposed is defined as a front side of the image reading apparatus 1. A left side of the image reading apparatus 1 when viewed by a user opposed to the output tray 6 is defined as a left side of the image reading apparatus 1. That is, a back side of the sheet illustrating FIG. 1 is defined as the left side of the image reading apparatus 1. The sides and directions in FIGS. 2-13 are defined with respect to the sides and directions in FIG. 1. There will be described components and devices of the image reading apparatus 1 with reference to the drawings.

Overall Construction

Figure 2:
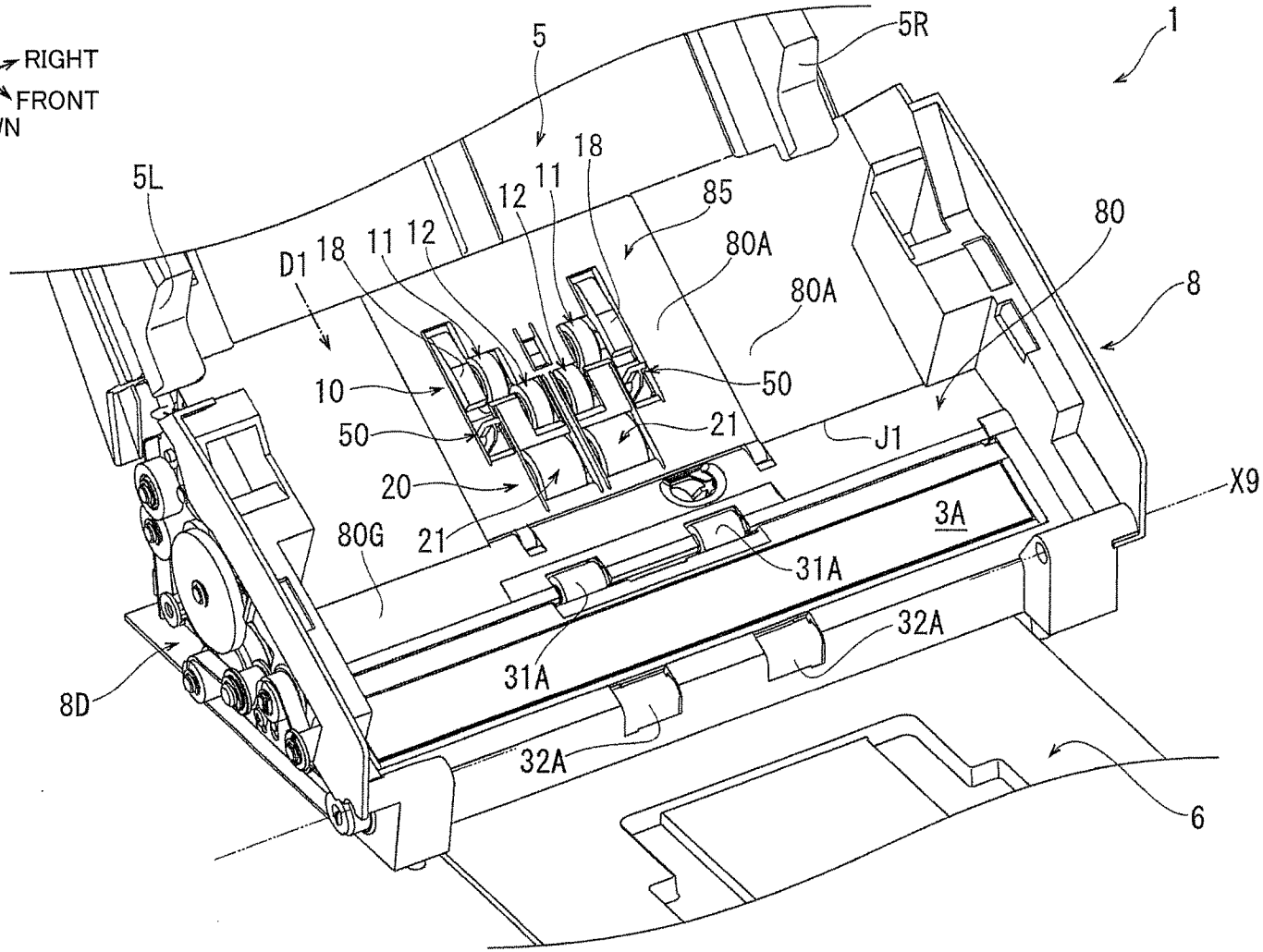
FIG. 2 is a perspective view of a first housing.
Figure 3:
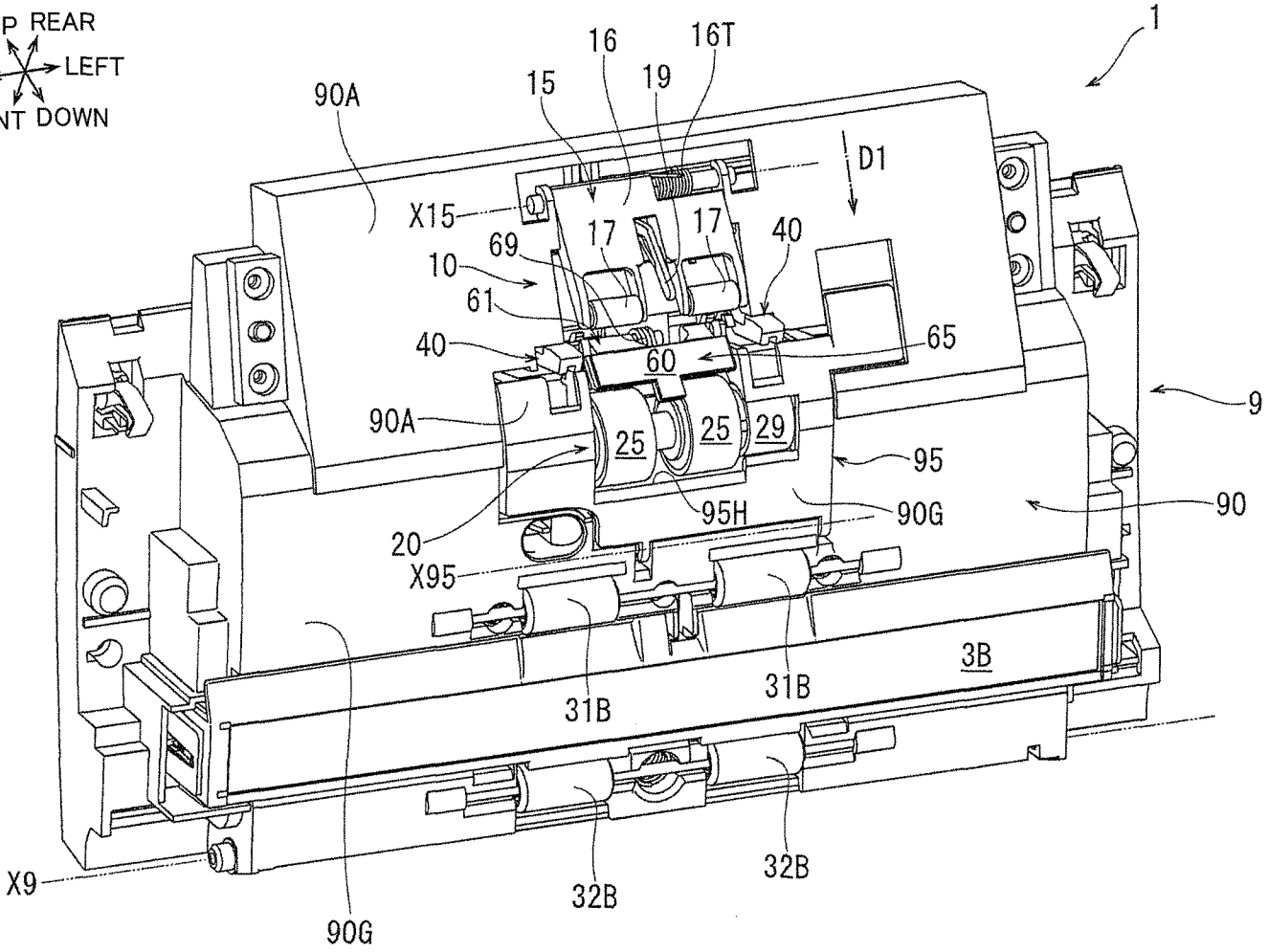
FIG. 3 is a perspective view of a second housing.

As illustrated in FIGS. 1-3, the image reading apparatus 1 includes a first housing 8, a second housing 9, a supply tray 5, and the output tray 6. The second housing 9 is disposed over the first housing 8. The second housing 9 is coupled at its front end portion to the first housing 8 so as to be pivotable about an open/close axis X9 extending in the right and left direction through a front end portion of the first housing 8. In the present embodiment, the right and left direction is orthogonal to a direction in which a sheet is conveyed (hereinafter may be referred to as "conveying direction"). The right and left direction corresponds to the widthwise direction of the supply tray 5.

Figure 4:
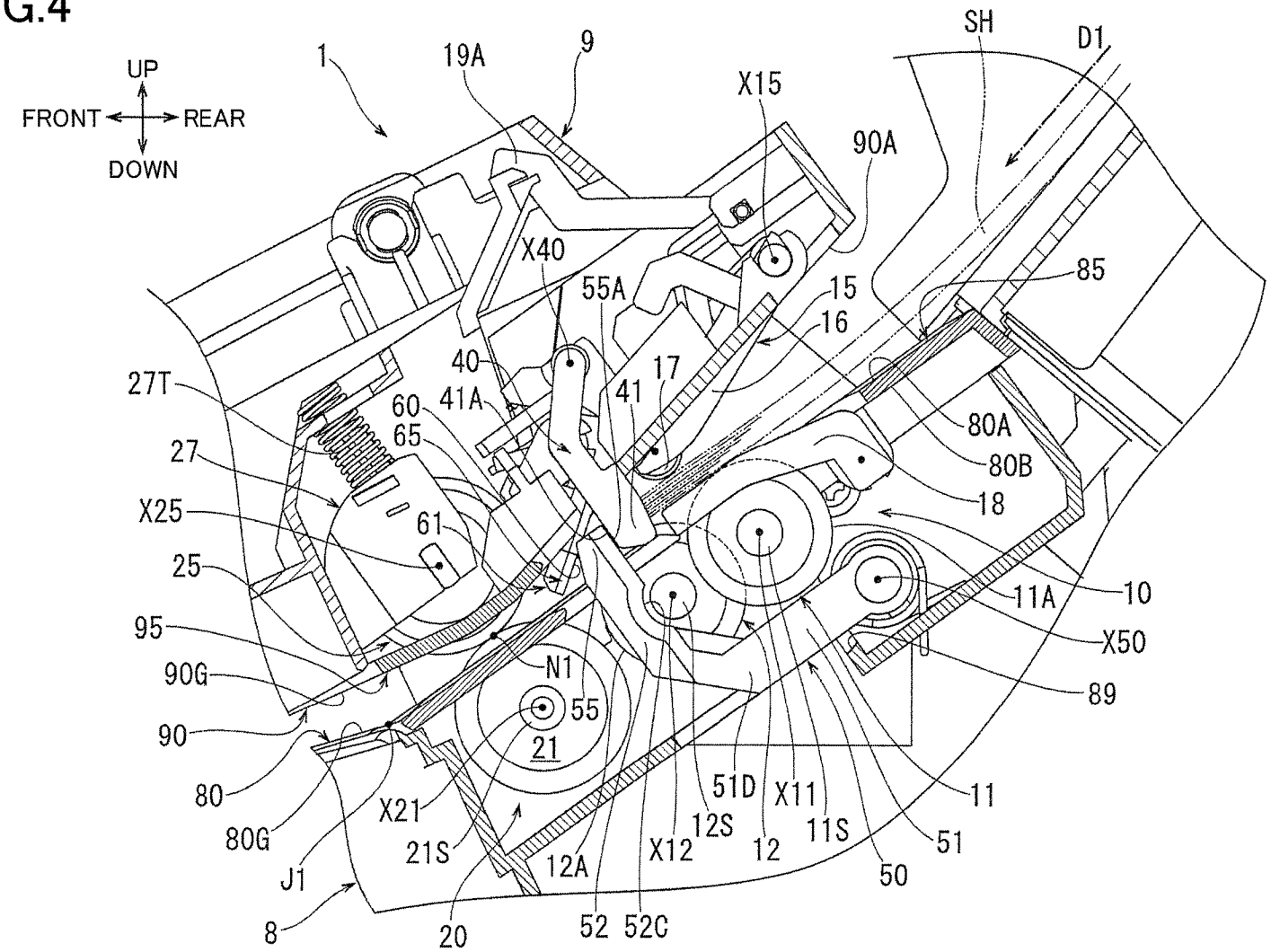
FIG. 4 is a partial cross-sectional view of components including a supplier, a separator, a pressing member, stoppers, and stopper cams.

As illustrated in FIGS. 2 and 4, an upper surface of the first housing 8 is constituted by an upper surface of a lower chute 80. The upper surface of the first housing 8 is inclined so as to be lower at its rear end portion than at its front end portion. The upper surface of the first housing 8 is divided into a front portion and a rear portion by a reference line J1 that is set at a substantially intermediate portion of the upper surface in the front and rear direction. The angle of inclination of the front portion of the upper surface of the first housing 8 is less than the angle of inclination of the rear portion of the upper surface of the first housing 8. A support surface 80A is formed on the rear portion of the upper surface of the first housing 8. A lower conveying surface 80G is formed on the front portion of the upper surface of the first housing 8. While a seam between the components is used to define the reference line in the present embodiment, the present disclosure is not limited to this configuration. For example, a component or a position at which the inclination angle changes may be used as the reference line.

Figure 6:
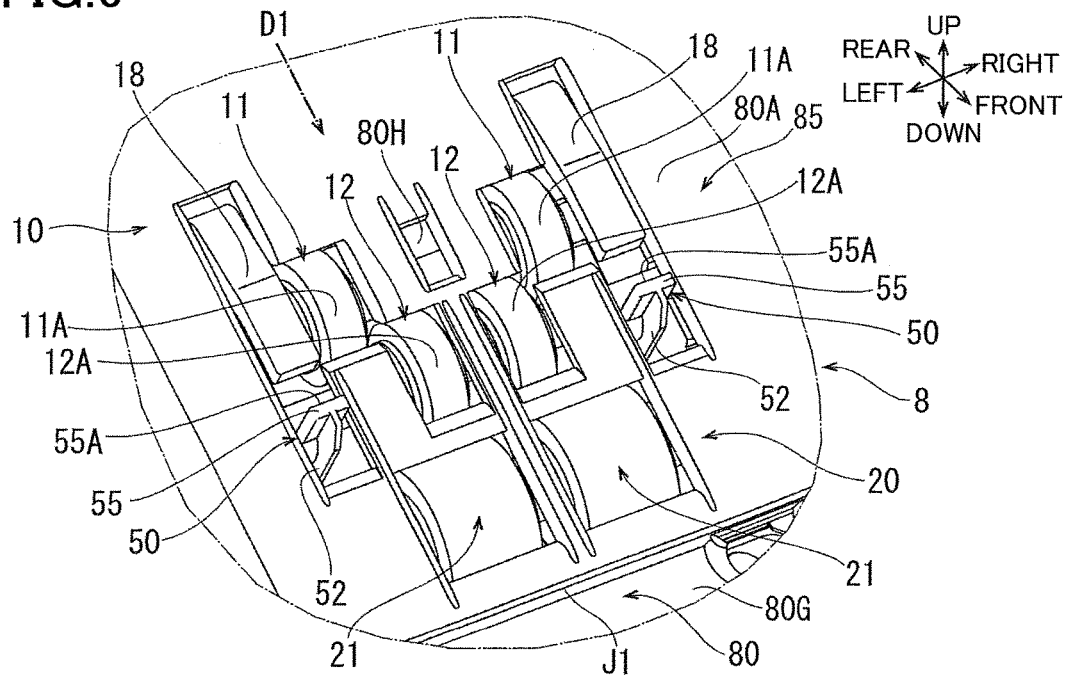
FIG. 6 is a partial perspective view of components including a support surface, first and second supply rollers, separating rollers, and the stopper cams.

The lower chute 80 is one example of a supporter. As illustrated in FIGS. 2, 4, and 6, the lower chute 80 is installed with a lower cover 85 that is opened and closed in maintenance, for example. The lower cover 85 is disposed on the rear portion of the upper surface of the first housing 8 at a central portion of the first housing 8 in the right and left direction. An upper surface of the lower cover 85 also forms a portion of the support surface 80A with the upper surface of the lower chute 80.

As illustrated in FIGS. 3 and 4, a lower surface of the second housing 9 is constituted by a lower surface of an upper chute 90. The lower surface of the second housing 9 is inclined so as to be lower at its rear end portion than at its front end portion. A guide surface 90A is formed on the lower surface of the second housing 9 at an area opposed to the support surface 80A of the first housing 8. An upper conveying surface 90G is formed on the lower surface of the second housing 9 at an area opposed to the lower conveying surface 80G of the first housing 8. The angle of inclination of the upper conveying surface 90G is less than the angle of inclination of the guide surface 90A. As illustrated in FIG. 4, the guide surface 90A extending from a rear end portion of the second housing 9 is inclined so as to be nearer to the support surface 80A of the first housing 8 at a front portion of the guide surface 90A than at a rear portion thereof. That is, a distance between the support surface 80A and the front portion of the guide surface 90A is less than a distance between the support surface 80A and the rear portion of the guide surface 90A.

Figure 7:
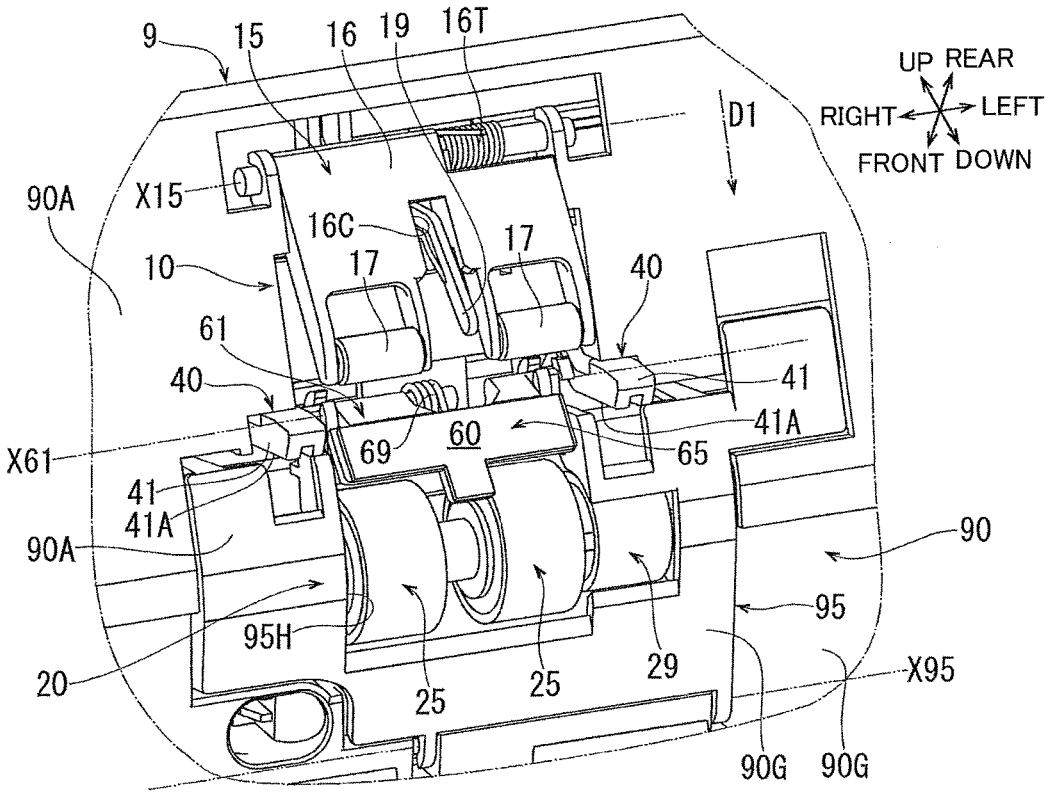
FIG. 7 is a partial perspective view of components including retard rollers, the pressing member, and the stoppers.

As illustrated in FIGS. 3, 4, and 7, the upper chute 90 is installed with a cover 95 that is opened and closed in maintenance, for example. The cover 95 is disposed on an intermediate portion of the lower surface of the second housing 9 in the front and rear direction at a central portion of the second housing 9 in the right and left direction. Like the lower surface of the upper chute 90, the angle of inclination of a front portion of a lower surface of the cover 95 is less than the angle of inclination of a rear portion of the lower surface of the cover 95. The rear portion of the lower surface of the cover 95 forms a portion of the guide surface 90A with a portion of the lower surface of the upper chute 90. The front portion of the lower surface of the cover 95 forms a portion of the upper conveying surface 90G with a portion of the lower surface of the upper chute 90.

As illustrated in FIG. 2, the supply tray 5 is connected to a rear end portion of the first housing 8 and inclined so as to be higher at a rear portion of the supply tray 5 than at a front portion thereof. Edge guides (width limiting guides) 5L, 5R are provided on an upper surface of the supply tray 5 so as to be slidable in the right and left direction. The edge guides 5L, 5R are movable toward and away from each other in the right and left direction with respect to the center of the supply tray 5. With this construction, various sizes of sheets SH placed on the supply tray 5 may be positioned in the right and left direction by the edge guides 5L, 5R. The sizes of the sheets SH placeable on the supply tray 5 range from a business-card size to the A4 size, for example.

As illustrated in FIGS. 1 and 2, the output tray 6 extends frontward from a position located below the lower conveying surface 80G formed on the front end portion of the first housing 8.

As illustrated in FIG. 1, a conveyance path P1 is defined between the upper surface of the first housing 8 and the lower surface of the second housing 9. The support surface 80A and the lower conveying surface 80G of the first housing 8 illustrated in FIG. 2 define the conveyance path P1 from below. The guide surface 90A and the upper conveying surface 90G of the second housing 9 illustrated in FIG. 3 define the conveyance path P1 from above. The sheet SH to be conveyed for image reading is supported over the supply tray 5 and the support surface 80A. The sheet SH is conveyed in a conveying direction D1 along the conveyance path P1 and discharged onto the output tray 6. The conveying direction D1 is directed frontward and downward from the upstream supply tray 5 toward the downstream output tray 6.

As indicated by the two-dot chain line in FIG. 1, the second housing 9 is pivotable about the open/close axis X9 so as to move its rear end portion upward and frontward. This pivotal movement moves the second housing 9 off the upper surface of the first housing 8 so as to expose the conveyance path P1.

The image reading apparatus 1 includes a supplier 10, a separator 20, first conveying rollers 31A, first pinch rollers 31B, a first reader 3A, a second reader 3B, second conveying rollers 32A, and second pinch rollers 32B along the conveyance path P1.

Constructions of the supplier 10 and the separator 20 will be described later in detail. As illustrated in FIGS. 3-10, the image reading apparatus 1 further includes a holder 61, a friction member 65, an inclined surface 60, stoppers 40, and stopper cams 50 along the conveyance path P1, and constructions of these components will also be described later in detail.

As illustrated in FIGS. 1 and 4, the supplier 10 includes first supply rollers 11 and second supply rollers 12. The sheets SH supported on the supply tray 5 and the support surface 80A are supplied by these rollers 11, 12 along the conveyance path P1 toward the downstream side in the conveying direction D1. The separator 20 includes two separating rollers 21 and two retard rollers 25. The sheets SH supplied from the supplier 10 are separated one by one and conveyed toward the downstream side in the conveying direction D1.

As illustrated in FIG. 2, the first conveying rollers 31A, the first reader 3A, and the second conveying rollers 32A are provided on the first housing 8.

The first conveying rollers 31A are rotatably supported by the lower chute 80 in a state in which outer circumferential surfaces of the respective first conveying rollers 31A are partly exposed from an intermediate portion of the lower conveying surface 80G in the front and rear direction.

The first reader 3A is assembled to the lower chute 80 at a position located downstream of the first conveying rollers 31A in the conveying direction D1. Examples of the first reader 3A include a contact image sensor (CIS) and a charge coupled device (CCD). The first reader 3A has a reading surface facing upward. This reading surface defines a portion of the conveyance path P1 from below with the lower conveying surface 80G.

The second conveying rollers 32A are rotatably supported by the lower chute 80 in a state in which outer circumferential surfaces of the respective second conveying rollers 32A are partly exposed from a front end portion of the lower conveying surface 80G.

As illustrated in FIG. 3, the first pinch rollers 31B, the second reader 3B, and the second pinch rollers 32B are provided on the second housing 9.

The first pinch rollers 31B are rotatably supported by the upper chute 90 in a state in which outer circumferential surfaces of the first pinch rollers 31B are partly exposed from an intermediate portion of the upper conveying surface 90G in the front and rear direction. The first pinch rollers 31B are pressed against the first conveying rollers 31A respectively by urging springs, not illustrated, so as to be rotated by rotation of the first conveying rollers 31A.

The second reader 3B is assembled to the upper chute 90 at a position located downstream of the first pinch rollers 31B in the conveying direction D1. The second reader 3B employs a sensor similar to the sensor employed for the first reader 3A. The second reader 3B has a reading surface facing downward. This reading surface defines a portion of the conveyance path P1 from above with the upper conveying surface 90G.

The second pinch rollers 32B are rotatably supported by the upper chute 90 in a state in which outer circumferential surfaces of the second pinch rollers 32B are partly exposed from a front end portion of the upper conveying surface 90G. The second pinch rollers 32B are pressed against the second conveying rollers 32A respectively by urging springs, not illustrated, so as to be rotated by rotation of the second conveying rollers 32A.

As illustrated in FIG. 1, the image reading apparatus 1 includes a control board 2 and a motor M1. The control board 2 and the motor M1 are provided in the first housing 8. The control board 2 as a controller is configured to control the motor M1, the first reader 3A, and the second reader 3B in an image reading operation. Also, the control board 2 receives inputs and instructions from a user and displays information relating to operations and settings of the image reading apparatus 1 via, e.g., an input/output panel, not illustrated. As illustrated in FIG. 2, a transmission mechanism 8D is provided in the first housing 8 at a position located on an inner side of a left wall of the first housing 8. The transmission mechanism 8D includes a gear group, pulleys and pulley belts, and a one-way clutch. The transmission mechanism 8D is mounted on a frame, not illustrated, in the first housing 8. When the motor M1 is controlled by the control board 2 and rotated forwardly, a driving force generated by the motor M1 is transmitted to the first supply rollers 11, the second supply rollers 12, the separating rollers 21, the first conveying rollers 31A, and the second conveying rollers 32A via the transmission mechanism 8D to rotate their respective outer circumferential surfaces in directions for conveying the sheet SH in the conveying direction D1.

Each of the sheets SH separated one by one by the separator 20 is conveyed by the first conveying rollers 31A and the first pinch rollers 31B toward the first reader 3A and the second reader 3B. After completion of image reading by the first reader 3A and the second reader 3B, the sheet SH is discharged onto the output tray 6 by the second conveying rollers 32A and the second pinch rollers 32B.

Supplier

As illustrated in FIGS. 2-7, the supplier 10 includes the first supply rollers 11, the second supply rollers 12, a pressing member 15, a sheet sensor 19, and two set guides 18. Each of the first supply rollers 11 and the second supply rollers 12 is one example of a supply roller.

Figure 5:
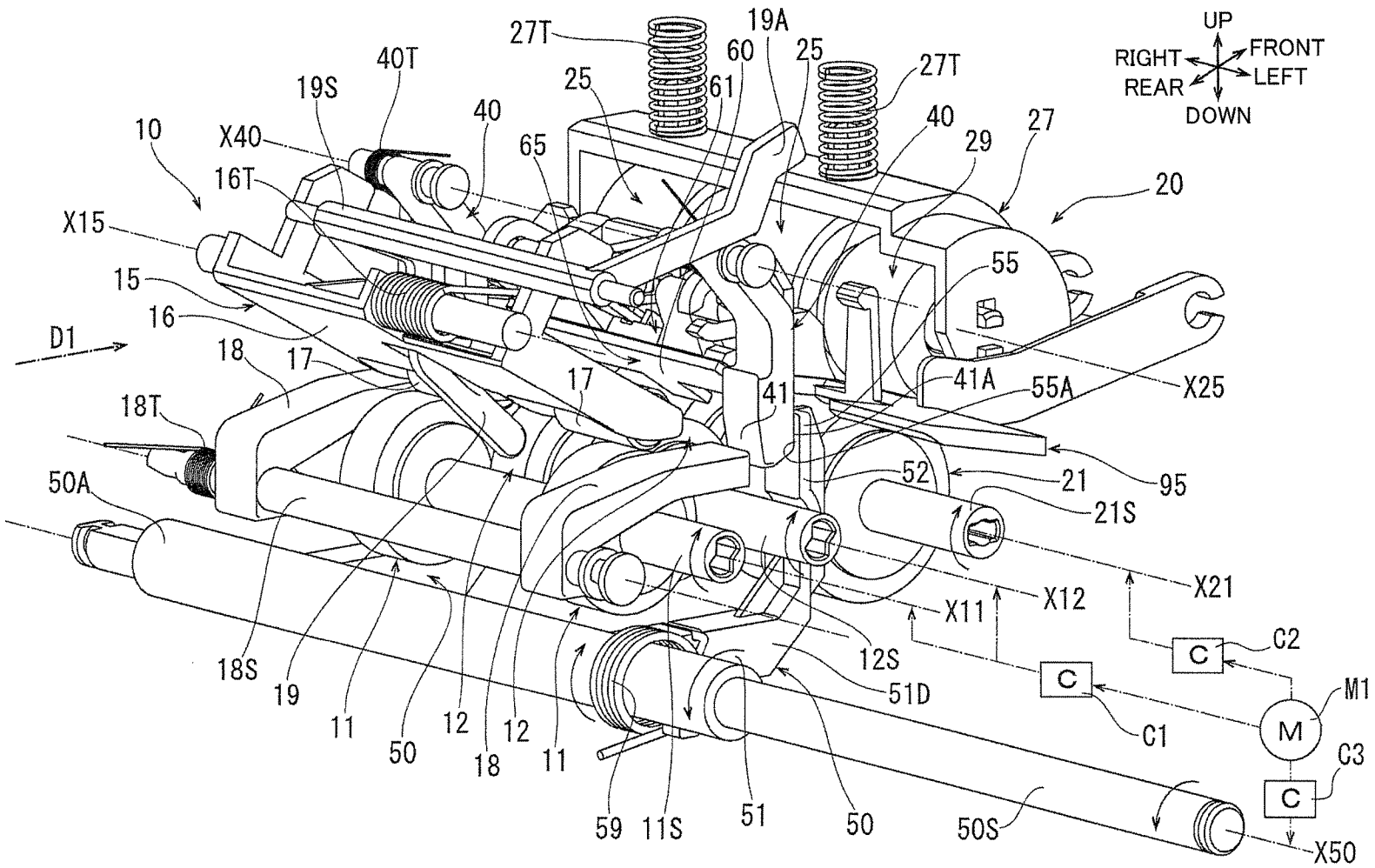
FIG. 5 is a perspective view of components including the supplier, the separator, the pressing member, the stoppers, and the stopper cams.

As illustrated in FIGS. 4-6, the two first supply rollers 11 are spaced apart from each other in the right and left direction. The first supply rollers 11 are fixed to a first rotation shaft 11S so as to be rotatable together with the first rotation shaft 11S. The first rotation shaft 11S defines a first rotation axis X11 extending in the right and left direction. Likewise, the two second supply rollers 12 are spaced apart from each other in the right and left direction. The second supply rollers 12 are fixed to a second rotation shaft 12S so as to be rotatable together with the second rotation shaft 12S. The second rotation shaft 12S defines a second rotation axis X12 extending in the right and left direction. The second supply rollers 12 are disposed downstream of the first supply rollers 11 in the conveying direction D1.

That is, the first supply rollers 11 and the second supply rollers 12 disposed in the same orientation in the conveying direction D1 are arranged at mutually different positions. The first supply rollers 11 are arranged in a row in the right and left direction in which the first rotation shaft 11S extends. The second supply rollers 12 are arranged in a row in the right and left direction in which the second rotation shaft 12S extends. The row of the first supply rollers 11 and the row of the second supply rollers 12 are different from each other in position in the conveying direction D1. The two first supply rollers 11 are provided on opposite sides of the two second supply rollers 12 in the right and left direction.

Figure 9:
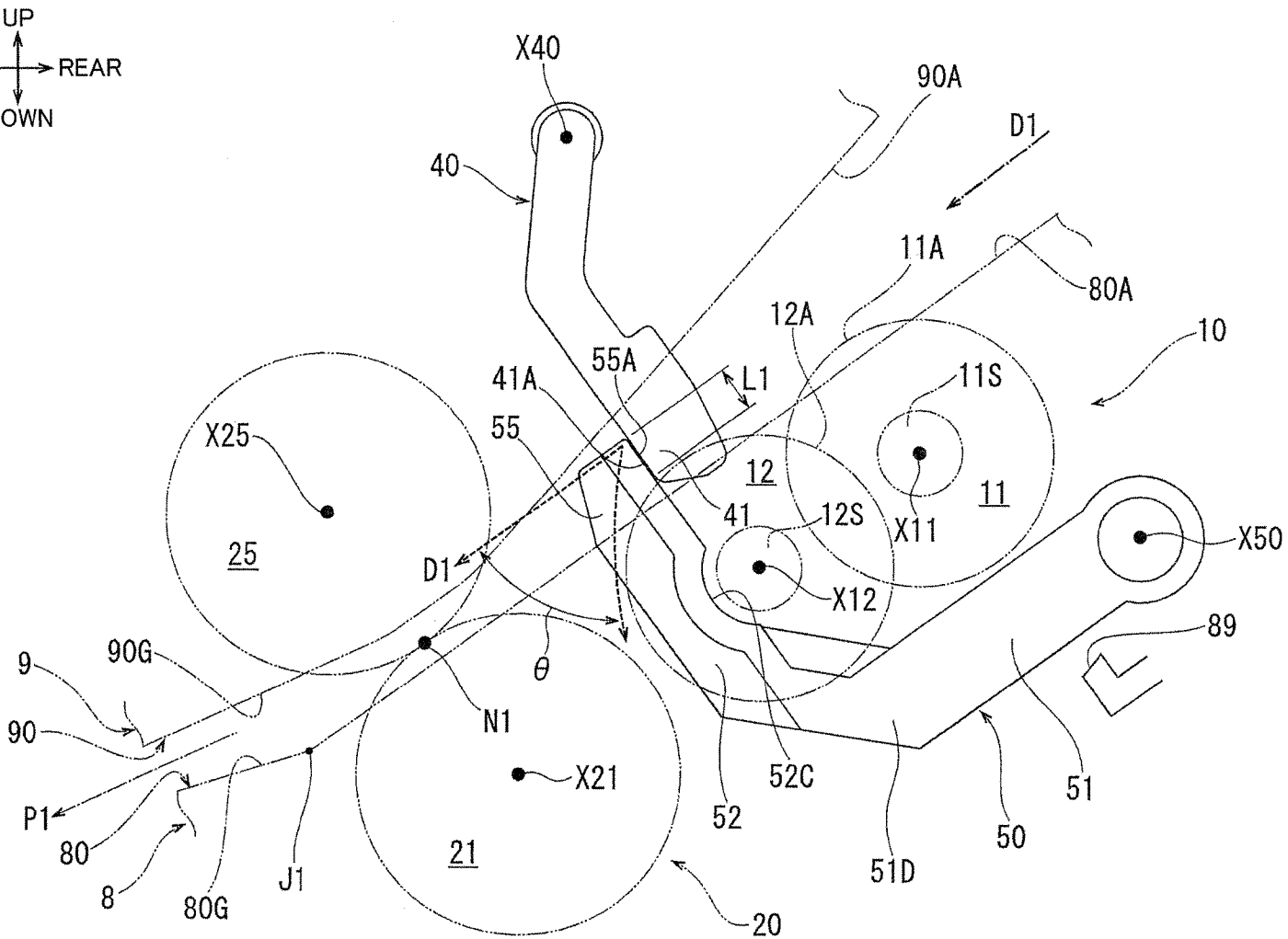
FIG. 9 is a schematic view for explaining a positional relationship among the supplier, the stoppers, and the stopper cams.

As illustrated in FIG. 4, an opposite surface of the lower chute 80 from the support surface 80A is a back surface 80B. The first rotation axis X11 and the second rotation axis X12 are located below a portion of the back surface 80B. Each of the first rotation axis X11 and the second rotation axis X12 is one example of a rotation axis As illustrated in FIG. 9, each of the first supply rollers 11 has a first cylindrical surface 11A. A portion of the first cylindrical surface 11A is exposed from the support surface 80A. Each of the second supply rollers 12 has a second cylindrical surface 12A. A portion of the second cylindrical surfaces 12A is exposed from the support surface 80A. Each of the first cylindrical surfaces 11A and the second cylindrical surfaces 12A is one example of an outer circumferential surface of the supply roller.

As illustrated in, e.g., FIGS. 4, 5, and 7, the pressing member 15 includes an arm 16 and two rotation members 17. The arm 16 is coupled to the upper chute 90 so as to be pivotable about a second pivot axis X15. The second pivot axis X15 extends in the right and left direction through a rear end portion of the guide surface 90A of the second housing 9. That is, the second pivot axis X15 is located upstream of the first supply rollers 11 in the conveying direction D1.

The arm 16 is opposed to the support surface 80A and inclined so as to be lower at a front portion of the arm 16 than at a rear portion thereof. A downstream end portion of the arm 16 in the conveying direction D1 is opposed to portions of the first cylindrical surfaces 11A which are exposed from the support surface 80A. The two rotation members 17 are spaced apart from each other in the right and left direction and rotatably supported by the downstream end portion of the arm 16 in the conveying direction D1.

The rotation members 17 are respectively opposed to the first cylindrical surfaces 11A of the respective first supply rollers 11. The arm 16 is urged by a torsion coil spring 16T illustrated in FIG. 5 so as to pivot in a direction in which the rotation members 17 are moved toward the first cylindrical surfaces 11A. As illustrated in FIG. 4, this construction enables the rotation members 17 to contact an uppermost one of the sheets SH supported on the support surface 80A to press the sheets SH onto the first supply rollers 11.

As illustrated in FIG. 7, the arm 16 has a cutout 16C formed between the rotation members 17. The arm 16 is recessed toward the second pivot axis X15 by the cutout 16C. The sheet sensor 19 protrudes downward from the second housing 9 through the cutout 16C formed in the arm 16. As illustrated in FIG. 5, an upper end portion of the sheet sensor 19 is connected to a pivot shaft 19S pivotably supported in the second housing 9. A shutter 19A is connected to the pivot shaft 19S.

As illustrated in FIG. 6, the support surface 80A has a recess 80H formed between the first supply rollers 11. Though not illustrated, a distal end portion of the sheet sensor 19 is located in the recess 80H in a state in which no sheet SH is supported on the support surface 80A. In a state in which the sheet or sheets SH are supported on the support surface 80A, in contrast, the distal end portion of the sheet sensor 19 is pushed up by the sheets SH and spaced apart from the recess 80H. The shutter 19A exposes or intercepts a path of light emitted by a photo interrupter, not illustrated, in accordance with the movement of the sheet sensor 19, and a detection signal output from the photo interrupter, not illustrated, is transmitted to the control board 2. The control board 2 determines based on the detection signal whether the sheet or sheets SH are supported on the support surface 80A.

As illustrated in FIGS. 4-6, the two set guides 18 are spaced apart from each other in the right and left direction. The set guides 18 are adjacent to the respective first supply rollers 11. The left set guide 18 is disposed to the left of the left first supply roller 11. The right set guide 18 is disposed to the right of the right first supply roller 11.

As illustrated in FIG. 5, the left set guide 18 is connected to a left end portion of a pivot shaft 18S pivotably supported by the frame, not illustrated, in the first housing 8. The right set guide 18 is connected to a right end portion of the pivot shaft 18S. As illustrated in FIGS. 4 and 6, each of the right and left set guides 18 extends toward the downstream side in the conveying direction D1, and upper surfaces of the right and left set guides 18 are exposed from the support surface 80A. The right and left set guides 18 are urged by a torsion coil spring 18T illustrated in FIG. 5 such that their respective upper surfaces exposed from the support surface 80A are situated above the support surface 80A.

As illustrated in FIG. 4, a leading edge of each sheet SH supported by the support surface 80A is guided by the arm 16 of the pressing member 15 and the set guides 18 so as to pass through the first supply rollers 11 without being caught by the first supply rollers 11 and then nipped by the first supply rollers 11 and the rotation members 17 of the pressing member 15.

Figure 8:
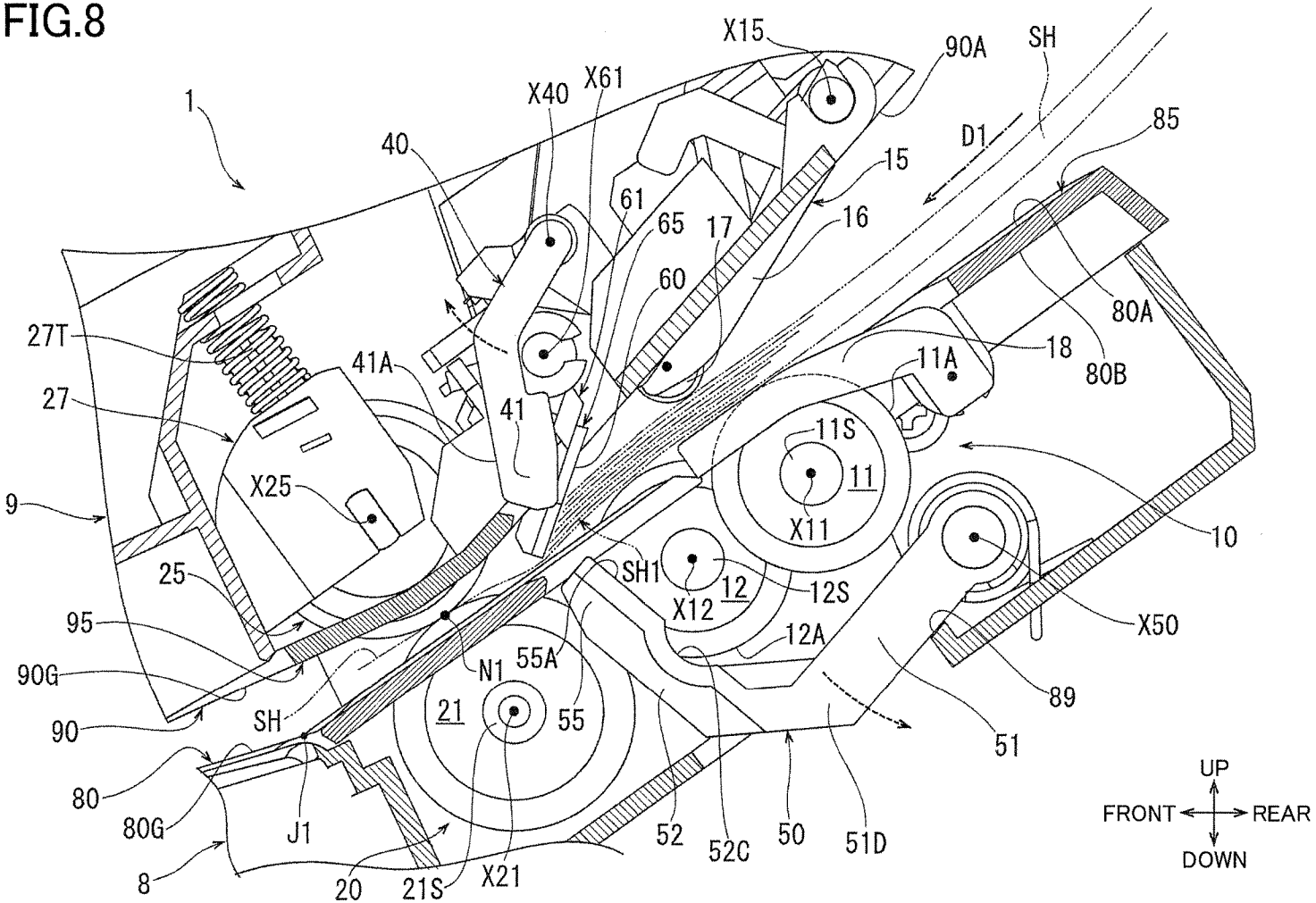
FIG. 8 is a partial cross-sectional view of the supplier, the separator, the pressing member, the stoppers, and the stopper cams.

As illustrated in FIG. 5, forward rotation of the motor M1 establishes a connected state of a one-way clutch C1, so that the driving force is transmitted to the first rotation shaft 11S and the second rotation shaft 12S. This transmission causes the first supply rollers 11 to be rotated about the first rotation axis X11 in a direction in which the sheet SH is to be conveyed in the conveying direction D1. Also, the second supply rollers 12 are rotated about the second rotation axis X12 in the direction in which the sheet SH is to be conveyed in the conveying direction D1. As a result, as illustrated in FIG. 8, the sheet SH supported on the support surface 80A is supplied by the supplier 10 along the conveyance path P1 toward the downstream side in the conveying direction D1.

It is noted that when the motor M1 is rotated reversely, the one-way clutch C1 illustrated in FIG. 5 is in a disconnected state, so that no driving force is transmitted to the first rotation shaft 11S and the second rotation shaft 12S.

Separator

As illustrated in FIGS. 2-7, the separator 20 includes the two separating rollers 21 and the retard rollers 25. The separating rollers 21 and the retard rollers 25 are located downstream of the supplier 10 in the conveying direction D1. As illustrated in FIG. 4, the separating rollers 21 and the retard rollers 25 are disposed upstream of, in the conveying direction D1, the reference line J1 as a boundary between the support surface 80A and the lower conveying surface 80G. In other words, the support surface 80A extends to a position located downstream of the separator 20 in the conveying direction D1 and defines a portion of the conveyance path P1 from below.

The two separating rollers 21 are spaced apart from each other in the right and left direction. The separating rollers 21 are fixed to a third rotation shaft 21S illustrated in FIGS. 4 and 5 so as to be rotatable together with the third rotation shaft 21S. The third rotation shaft 21S defines a third rotation axis X21 extending in the right and left direction.

As illustrated in FIG. 4, the third rotation axis X21 is located below a portion of the back surface 80B of the lower chute 80. As illustrated in FIG. 6, a portion of the third cylindrical surface 21A is exposed from the support surface 80A.

As illustrated in FIGS. 4, 5, and 7, the two retard rollers 25 are spaced apart from each other in the right and left direction. The retard rollers 25 are held by a retard-roller holder 27 so as to be rotatable about a fourth rotation axis X25. A torque limiter 29 is provided between the retard-roller holder 27 and the retard rollers 25. As illustrated in FIG. 4, the fourth rotation axis X25 extends over the support surface 80A in the right and left direction.

As illustrated in FIG. 7, a portion of each of outer circumferential surfaces of the retard rollers 25 is exposed from an opening 95H formed in the cover 95 constituting a portion of the guide surface 90A.

As illustrated in FIGS. 4 and 5, the retard rollers 25 are pressed toward the respective separating rollers 21 by a compression coil spring 27T mounted on an upper surface of the retard-roller holder 27. As illustrated in FIG. 8, the sheet SH supplied by the supplier 10 is nipped by the separating rollers 21 and the retard rollers 25 at a nip position N1.

As illustrated in FIG. 5, the forward rotation of the motor M1 establishes a connected state of a one-way clutch C2, so that the driving force is transmitted to the third rotation shaft 21S. This transmission causes the separating rollers 21 to be rotated about the third rotation axis X21 in the direction in which the sheet SH is to be conveyed in the conveying direction D1.

The torque limiter 29 stops rotation of the retard rollers 25 when torque acting on the retard rollers 25 pressed against the separating rollers 21 is less than or equal to a particular value. The torque limiter 29 allows rotation of the retard rollers 25 when the torque is greater than the particular value. Thus, in the case where a single sheet SH is supplied, the torque limiter 29 allows rotation of the retard rollers 25, so that the retard rollers 25 are rotated by rotation of the separating rollers 21 to convey the sheet SH in the conveying direction D1. In the case where the two or more sheets SH are supplied, the torque limiter 29 stops rotation of the retard rollers 25, so that a separating force in a direction reverse to the conveying direction D1 is applied to the sheets SH other than the sheet SH contacting the separating rollers 21.

It is noted that in the case where the motor M1 is rotated reversely, the one-way clutch C2 is in a disconnected state, so that no driving force is transmitted to the third rotation shaft 21S.

Holder, Friction Member, and Inclined Surface

As illustrated in, e.g., FIG. 7, the holder 61 is mounted on the cover 95 so as to be pivotable about a first pivot axis X61. The first pivot axis X61 extending in the right and left direction faces the support surface 80A from above. Specifically, the first pivot axis X61 extends through one of opposite end portions of the cover 95. An open/close axis X95 about which the cover 95 is pivotable extends through the other end portion of the cover 95. The friction member 65 is formed of a material such as rubber and an elastomer. A bonding material, such as a double-sided tape, is used to stick the friction member 65 to a surface of the base plate 61A which faces downward. The inclined surface 60 is constituted by a surface of the friction member 65 which faces downward. The inclined surface 60 is inclined so as to be nearer to the conveyance path P1 at a downstream portion of the inclined surface 60 in the conveying direction D1 than at an upstream portion thereof in the conveying direction D1.

As illustrated in FIGS. 4 and 8, the holder 61, the friction member 65, and the inclined surface 60 are provided upstream of the nip position N1 in the conveying direction D1. The holder 61, the friction member 65, and the inclined surface 60 are provided downstream of the first supply rollers 11 and the rotation members 17 of the pressing member 15 in the conveying direction D1.

The holder 61 is urged by a torsion coil spring 69 illustrated in FIG. 7 such that the inclined surface 60 is moved toward the second cylindrical surfaces 12A of the second supply rollers 12. The inclined surface 60 is kept at an initial position illustrated in FIGS. 4, 5, and 7 by an urging force of the torsion coil spring 69. As illustrated in FIG. 8, the inclined surface 60 pivots from the initial position when the inclined surface 60 is pushed by the supplied sheet or sheets SH toward the downstream side in the conveying direction D1. The entire inclined surface 60 is spaced apart from the second cylindrical surfaces 12A of the second supply rollers 12 in the state in which the inclined surface 60 is located at the initial position illustrated in FIG. 4. When the inclined surface 60 pivots from the initial position, the entire inclined surface 60 is moved away from the second cylindrical surfaces 12A.

Stoppers and Stopper Cams

As illustrated in FIGS. 2-10, the stoppers 40 and the stopper cams 50 are provided upstream of the separator 20 in the conveying direction D1. One pair of the stopper 40 and the stopper cam 50 and the other pair of the stopper 40 and the stopper cam 50 are provided on opposite sides of the separator 20 in the right and left direction in which the first rotation shaft 11S and the second rotation shaft 12S extend.

As illustrated in FIGS. 4 and 5, the stoppers 40 are supported in the second housing 9 so as to be pivotable about a third pivot axis X40. The third pivot axis X40 is one example of a first axis. The third pivot axis X40 extends over the support surface 80A in the right and left direction. As illustrated in FIGS. 4 and 7, the stoppers 40 are exposed from the guide surface 90A and protrude downward.

The stoppers 40 are urged by a torsion coil spring 40T illustrated in FIG. 5 toward a first position illustrated in FIGS. 3, 4, 5, 7, and 9. As illustrated in FIG. 4, when located at the first position, the stoppers 40 are located upstream of the inclined surface 60 in the conveying direction D1. Distal end portions 41 of the stoppers 40 extend to the support surface 80A and intersect the conveyance path P1 in the state in which the stoppers 40 are located at the first position.

As illustrated in FIG. 5, the distal end portion 41 of each of the stoppers 40 is substantially shaped like a quadrangular prism. As illustrated in FIG. 9, each of the distal end portions 41 of the stoppers 40 has a back surface 41A. The back surface 41A is a flat surface which faces the downstream side in the conveying direction D1 and which is substantially orthogonal to the support surface 80A in the state in which the stoppers 40 are located at the first position.

Figure 10:
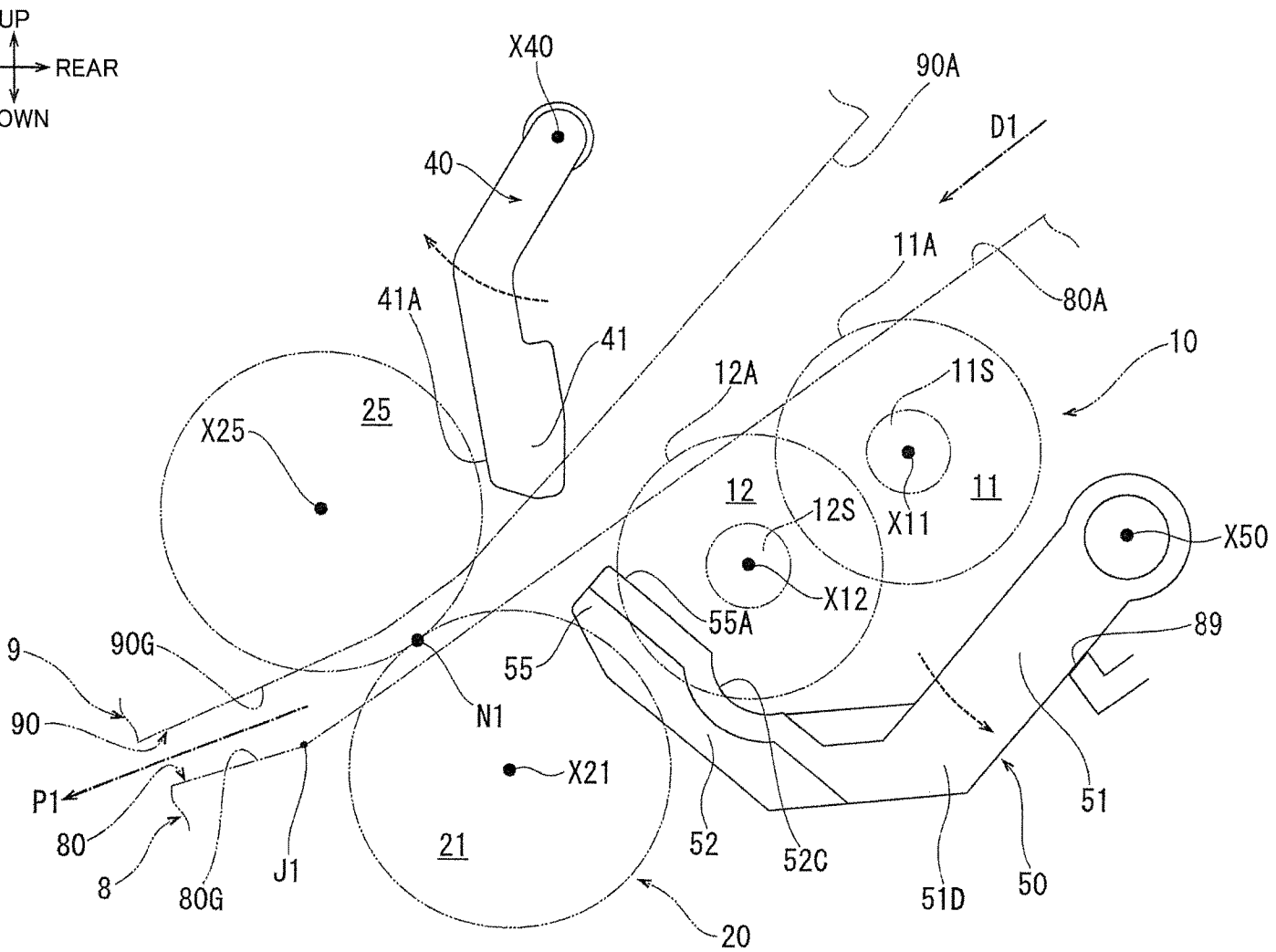
FIG. 10 is a schematic view for explaining a positional relationship among the supplier, the stoppers, and the stopper cams.

When the distal end portions 41 are pushed toward the downstream side in the conveying direction D1, the stoppers 40 pivot about the third pivot axis X40 so as to move to a second position illustrated in FIGS. 8 and 10. When the stoppers 40 are located at the second position, the distal end portions 41 of the stoppers 40 are separated from the support surface 80A.

As illustrated in FIG. 5, the left stopper cam 50 is connected to a left end portion of a cylindrical member 50A. The right stopper cam 50 is connected to a right end portion of the cylindrical member 50A. A transmission shaft 50S defining a fourth pivot axis X50 is inserted in the cylindrical member 50A in the first housing 8. The transmission shaft 50S is supported by the frame, not illustrated. The cylindrical member 50A is assembled to the transmission shaft 50S so as to be rotatable together with the transmission shaft 50S. The fourth pivot axis X50 is one example of a second axis.

As illustrated in FIG. 4, the fourth pivot axis X50 is located below a portion of the back surface 80B of the lower chute 80 and extends in the right and left direction. The fourth pivot axis X50 is located upstream of the first rotation shaft 11S of the first supply rollers 11 and the second rotation shaft 12S of the second supply rollers 12 in the conveying direction D1 and farther from the support surface 80A than the first rotation shaft 11S and the second rotation shaft 12S.

The stopper cams 50 pivot about the fourth pivot axis X50 so as to move between a third position illustrated in FIGS. 2, 4-6, and 9 and a fourth position illustrated in FIGS. 8 and 10.

As illustrated in FIG. 5, a left end portion of the transmission shaft 50S is connected to the motor M1 via a one-way clutch C3. A torsion coil spring 59 illustrated in FIG. 5 urges the stopper cams 50 toward the fourth position illustrated in FIGS. 8 and 10. The torsion coil spring 59 is one example of an urging member.

As illustrated in FIGS. 4 and 5, each of the stopper cams 50 includes a first portion 51 and a second portion 52. The first portion 51 extends from the fourth pivot axis X50 in the conveying direction D1. The first portions 51 are located farther from the support surface 80A than the first supply rollers 11 and the second supply rollers 12. The second portions 52 are respectively connected to downstream end portions 51D of the respective first portions 51 so as to extend upward toward the conveyance path P1. Each of the second portions 52 has a cutout 52C in its side surface that is opposed to the second rotation shaft 12S and located downstream of the second rotation shaft 12S in the conveying direction D1. The cutout 52C of the second portion 52 is substantially shaped like an arc that is recessed toward the downstream side in the conveying direction D1 so as to avoid the second rotation shaft 12S.

As illustrated in FIG. 8, a restrictor 89 is formed on the lower chute 80. The restrictor 89 is a rib opposed to the back surface 80B of the lower chute 80 and located farther from the support surface 80A than the first portions 51 of the stopper cams 50. The stopper cams 50 pivotable by the urging force of the torsion coil spring 59 illustrated in FIG. 5 are positioned at the fourth position illustrated in FIGS. 8 and 10 when the first portions 51 are stopped by contacting the restrictor 89.

As illustrated in FIG. 5, reverse rotation of the motor M1 establishes a connected state of the one-way clutch C3, so that a driving force generated by the motor M1 is transmitted to the transmission shaft 50S and the cylindrical member 50A. As a result, the stopper cams 50 are moved to the third position against the urging force of the torsion coil spring 59.

In the present embodiment, the motor M1 is a stepping motor. The motor M1 is rotated reversely by a particular angle and then kept at the position in an energized state by control of the control board 2, whereby the stopper cams 50 are accurately kept at the third position.

When the motor M1 is rotated forwardly, the one-way clutch C3 becomes a disconnected state, so that no driving force is transmitted to the transmission shaft 50S and the cylindrical member 50A. As a result, the stopper cams 50 are urged by the torsion coil spring 59 and moved to the fourth position.

As illustrated in FIGS. 4 and 9, when located at the third position, the stopper cams 50 are in contact with the distal end portions 41 of the respective stoppers 40 located at the first position, in a state in which distal ends of the stopper cams 50 are located downstream of the distal end portions 41 in the conveying direction D1, thereby limiting movement of the stoppers 40 to the second position. Specifically, as illustrated in FIG. 9, the second portion 52 of each of the stopper cams 50 includes a contact portion 55. The contact portion 55 is a distal end portion of the second portion 52 which protrudes from the support surface 80A and intersects the conveyance path P1 in the state in which the stopper cams 50 are located at the third position.

The contact portion 55 of the stopper cam 50 has a contact surface 55A which faces the upstream side in the conveying direction D1. The contact surface 55A is a flat surface which is substantially orthogonal to the support surface 80A in the state in which the stopper cams 50 are located at the third position. That is, the distal end portions 41 of the stoppers 40 located at the first position and the contact portions 55 of the stopper cams 50 located at the third position respectively come into surface contact with each other at the flat back surfaces 41A and the flat contact surfaces 55A. Thus, the length L1 of a portion of the contact surface 55A which is in contact with the back surface 41A is made relatively long, making it difficult for the contact surface 55A contacting with the back surface 41A to be moved off the back surface 41A. As a result, it is possible for the stopper cams 50 located at the third position to reliably prevent the stoppers 40 from moving to the second position. It is noted that the length L1 may be hereinafter referred to as "overlap amount L1".

The sign θ in FIG. 9 indicates an angle of intersection between the conveying direction D1 and an arc-shaped path of movement of distal ends of the contact portions 55 during movement of the stopper cams 50 from the third position to the fourth position. The above-described constructions of the stoppers 40 and the stopper cams 50 greatly reduce the angle θ when compared with the conventional sheet supplying apparatus described above. This reduction also makes it difficult for the contact surface 55A contacting with the back surface 41A to be moved off the back surface 41A.

As illustrated in FIGS. 8 and 10, when the stopper cams 50 are located at the fourth position, the contact portions 55 are spaced apart from the distal end portions 41 of the stoppers 40 located at the first position, thereby allowing movement of the stoppers 40 to the second position. In this movement, the contact portions 55 of the stopper cams 50 located at the fourth position do not protrude from the support surface 80A. Thus, the contact portions 55 do not hinder conveyance of the sheets SH.

Image Reading Operation

When the image reading apparatus 1 is turned on, the control board 2 determines whether the sheet or sheets SH are supported on the support surface 80A, based on a position of the sheet sensor 19. When the control board 2 determines that the sheet or sheets SH are supported on the support surface 80A, the control board 2 notifies the user of information indicating that the sheets SH should be removed from the support surface 80A. When the control board 2 determines that no sheet SH is supported on the support surface 80A, the control board 2 rotates the motor M1 reversely by the particular angle to move the stopper cams 50 to the third position. As a result, as illustrated in FIG. 9, the contact surfaces 55A of the contact portions 55 of the stopper cams 50 are brought into contact with the respective back surfaces 41A of the distal end portions 41 of the stoppers 40 to situate the stoppers 40 to the first position. The control board 2 then changes a state of the image reading apparatus 1 to a standby state.

When the sheet or sheets SH are placed on the supply tray 5 and the support surface 80A by the user, the control board 2 recognizes this placement based on a change of the position of the sheet sensor 19. At this time, as illustrated in FIG. 4, the stoppers 40 situated at the first position to prevent advance of the leading edges of the sheets SH supported on the support surface 80A. This construction reduces variations in positions of the leading edges of the sheets SH supported on the support surface 80A.

Upon reception of an instruction for performing the image reading operation, the control board 2 starts controlling the motor M1, the first reader 3A, and the second reader 3B. The control board 2 rotates the motor M1 forwardly to move the stopper cams 50 to the fourth position as illustrated in FIG. 10, thereby allowing movement of the stoppers 40 to the second position. The first supply rollers 11, the second supply rollers 12, the separating rollers 21, the first conveying rollers 31A, and the second conveying rollers 32A are rotated in directions in which the sheet SH is to be conveyed in the conveying direction D1.

As illustrated in FIG. 8, the sheet or sheets SH pressed onto the first supply rollers 11 by the pressing member 15 are conveyed by these rotated rollers toward the downstream side in the conveying direction D1. The conveyed sheet or sheets SH push the stoppers 40 to the second position. The sheet or sheets SH are conveyed through a wedge-shaped space formed by the support surface 80A, the second cylindrical surfaces 12A of the respective second supply rollers 12, and the inclined surface 60.

In the case where a plurality of the sheets SH are to be supplied, the inclined surface 60 reliably shapes leading edges SH1 of the stacked sheets SH into a wedge before the sheets SH come into contact with the separating rollers 21 and the retard rollers 25. This operation accurately limits the number of the sheets SH reaching the nip position N1, resulting in reduction in variations of positions of the leading edges of the sheets SH.

The sheets SH conveyed through the wedge-shaped space are nipped by the separating rollers 21 and the retard rollers 25. In the case where a plurality of the sheets SH are conveyed, one of the sheets SH is separated from the other by the separating rollers 21 and the retard rollers 25 and conveyed toward the downstream side in the conveying direction D1.

The first conveying rollers 31A and the first pinch rollers 31B convey the separated sheet SH toward the first reader 3A and the second reader 3B. The first reader 3A and the second reader 3B read an image formed on the sheet SH and transmit image information to the control board 2. The sheet SH for which image reading has been performed by the first reader 3A and the second reader 3B is discharged onto the output tray 6 by the second conveying rollers 32A and the second pinch rollers 32B.

At the end of the image reading operation, the control board 2 rotates the motor M1 reversely by the particular angle. This rotation moves the stopper cams 50 to the third position and situates the stoppers 40 to the first position. The control board 2 then changes the state of the image reading apparatus 1 to the standby state.

Operations and Effects

In the image reading apparatus 1 according to the present embodiment, as illustrated in FIGS. 4, 5, and 8-10, the stopper cams 50 are disposed so as to avoid contact with the separating rollers 21, the retard rollers 25, the first rotation shaft 11S of the first supply rollers 11, and the second rotation shaft 12S of the second supply rollers 12. Thus, in the image reading apparatus 1, it is possible to provide a large space for arrangement of the stopper cams 50 and a large area for movement of the stopper cams 50 from the third position to the fourth position. Also, as illustrated in FIG. 9, it is possible to reduce the angle θ of the intersection between the conveying direction D1 and the arc-shaped path of movement of the distal ends of the contact portions 55 during movement of the stopper cams 50 from the third position to the fourth position. These configurations makes it possible to increase the overlap amount during contact of the stopper cams 50 located at the third position with the respective distal end portions 41 of the stoppers 40 located at the first position, i.e., the length L1 of the portion of the contact surface 55A which is in contact with the back surface 41A illustrated in FIG. 9. As a result, even in the case where a shock is given to the stoppers 40 when the user places the sheets SH onto the support surface 80A, for example, the distal end portions 41 of the stoppers 40 are not easily separated from the respective stopper cams 50.

Accordingly, the image reading apparatus 1 according to the present embodiment well provides a function of the stoppers 40 to prevent advance of the leading edges of the sheets SH.

In this image reading apparatus 1, as illustrated in FIGS. 4 and 8, the pressing member 15 facing the support surface 80A is opposed to the first supply rollers 11, and the sheets SH supported on the support surface 80A are pressed against the first cylindrical surfaces 11A of the first supply rollers 11 by the pressing member 15, whereby the sheets SH supported on the support surface 80A are accurately conveyed toward the separator 20.

In this image reading apparatus 1, as illustrated in, e.g., FIG. 6, the first supply rollers 11 and the second supply rollers 12 are arranged in different positions in the conveying direction D1 and arranged in two rows in the direction in which the first rotation shaft 11S and the second rotation shaft 12S extend. With this configuration, in this image reading apparatus 1, even in the case where each of the first supply rollers 11 and the second supply rollers 12 has a small diameter, it is possible to stably convey the sheets SH toward the separator 20 by arranging these rollers 11, 12 at different positions.

In this image reading apparatus 1, as illustrated in, e.g., FIGS. 9 and 10, each of the stopper cams 50 includes the first portion 51 and the second portion 52. The first portion 51 is located farther from the support surface 80A than the first supply rollers 11 and the second supply rollers 12. This configuration enables arrangement of the stopper cams 50 by using a space free from the first supply rollers 11 and the second supply rollers 12. Also, as illustrated in FIG. 9, a direction in which the first portion 51 extends coincides with the conveying direction D1 in which a shock or the like is given to the stoppers 40 when the user places the sheets SH onto the support surface 80A. With this configuration, the stopper cams 50 well prevent movement of the stoppers 40 from the first position to the second position. Also, a force acting on the first portion 51 is only a tensile force in the conveying direction D1, making it difficult for the first portions 51 of the stopper cams 50 to be bent. This configuration reduces movement of distal ends of the second portions 52 of the stopper cams 50, i.e., the contact surfaces 55A, thereby reliably reducing even small movement of the stoppers 40 kept at the first position by contact of the second portion 52.

In this image reading apparatus 1, as illustrated in, e.g., FIG. 4, the second portion 52 has the cutout 52C recessed so as to avoid the second rotation shaft 12S. This configuration prevents interference between the second rotation shaft 12S of the second supply rollers 12 and the stopper cams 50 while effectively using a limited space near the first supply rollers 11, the second supply rollers 12, and the separator 20.

In this image reading apparatus 1, as illustrated in FIG. 8, the stopper cams 50 are situated to the fourth position by contact of the first portions 51 with the restrictor 89 that faces the back surface 80B of the lower chute 80. With this configuration, the restrictor 89 is easily disposed at a position not interfering with operations of other components, to accurately situate the stopper cams 50 to the fourth position.

In this image reading apparatus 1, as illustrated in FIG. 5, reverse rotation of the motor M1 establishes the connected state of the one-way clutch C3 to move the stopper cams 50 to the third position, while forward rotation of the motor M1 establishes the disconnected state of the one-way clutch C3 to move the stopper cams 50 to the fourth position by the urging force of the torsion coil spring 59. This simple configuration enables movement of the stopper cams 50 between the third position and the fourth position at a desired timing. In this image reading apparatus 1, the single motor M1 controls both of driving of the separating rollers 21 and movement of the stopper cams 50. This configuration reduces the manufacturing cost and the size of the image reading apparatus 1 when compared with a case where two motors are used.

In this image reading apparatus 1, as illustrated in FIGS. 4 and 5, the separating rollers 21 are rotated about the third rotation axis X21 that extends below a portion of the back surface 80B of the lower chute 80. The retard rollers 25 are rotated about the fourth axis X25 that extends over the support surface 80A, and the retard rollers 25 include the torque limiter 29. The torque limiter 29 limits the rotation of the retard rollers 25 in the following manner. In the case where a single sheet SH is to be supplied, the retard rollers 25 are rotated by rotation of the separating rollers 21 to convey the sheet SH in the conveying direction D1. In the case where a plurality of the sheets SH are supplied, rotation of the retard rollers 25 is stopped, so that a separating force in a direction reverse to the conveying direction D1 is applied to the sheet or sheets SH other than the sheet SH contacting the separating rollers 21. That is, in this image reading apparatus 1, the retard rollers 25 are passive rollers which are not driven directly, whereby the components which are directly driven are provided facing the back surface 80B of the lower chute 80. This configuration simplifies the second housing 9 and the transmission mechanism 8D illustrated in FIG. 2, for example, resulting in reduced manufacturing cost.

In this image reading apparatus 1, as illustrated in, e.g., FIG. 5, one pair of the stopper 40 and the stopper cam 50 and the other pair of the stopper 40 and the stopper cam 50 are provided on opposite sides of the separator 20 in the right and left direction in which the first rotation shaft 11S and the second rotation shaft 12S extend, making it possible to properly restrict movement of the leading edges of the sheets SH on opposite sides of the separator 20.

While the embodiment has been described above, it is to be understood that the disclosure is not limited to the details of the illustrated embodiment, but may be embodied with various changes and modifications, which may occur to those skilled in the art, without departing from the spirit and scope of the disclosure.

While the stoppers 40 are located above the conveyance path P1, and the stopper cams 50 are located below the conveyance path P1 in the above-described embodiment, this positional relationship may be reversed.

While the separating rollers 21 and the support surface 80A are disposed on the same side of the conveyance path P1, and the retard rollers 25 are disposed on an opposite side of the conveyance path P1 from the support surface 80A in the above-described embodiment, this positional relationship may be reversed.

The present disclosure may be applied to image reading apparatuses, image forming apparatuses, and multi-function peripherals, for example.

What is claimed is:

1. A sheet conveying apparatus, comprising:

a supporter comprising a support surface configured to support a plurality of sheets;

a supplier comprising a supply roller rotatable about a rotation axis, the supply roller comprising an outer circumferential surface partly exposed from the support surface and configured to supply one or more sheets supported by the support surface toward a downstream side in a conveying direction along a conveyance path by rotating in contact with the one or more sheets supported by the support surface in a direction for supplying the one or more sheets in the conveying direction;

a separator disposed downstream of the supplier in the conveying direction and configured to separate, at a nip position thereof, one by one the one or more sheets supplied by the supplier and convey the separated sheet toward the downstream side in the conveying direction;

a stopper disposed upstream of the nip position of the separator in the conveying direction and pivotable, about a first axis that is located opposite to the rotation axis of the supply roller relative to the support surface, between (i) a first position at which a distal end portion of the stopper extends to the support surface intersects the conveyance path and stops the plurality of sheets supported by the support surface, and (ii) a second position at which the distal end portion is separated from the support surface and is located more downstream in the conveying direction than at the first position, wherein the distal end portion has a downstream surface facing downstream in the conveying direction;

a stopper cam disposed upstream of the nip position of the separator in the conveying direction, having a contact surface facing upstream in the conveying direction, and pivotable, about a second axis that is located opposite to the first axis relative to the support surface, between (a) a third position at which the contact surface of the stopper cam is in contact with the downstream surface of the distal end portion of the stopper located at the first position to restrict pivoting of the stopper toward the second position, and (b) a fourth position at which the contact surface of the stopper cam is spaced apart from the downstream surface of the distal end portion of the stopper to allow pivoting of the stopper from the first position toward the second position; and an inclined surface disposed upstream of the nip position of the separator in the conveying direction and pivotable, about a third axis that is located opposite to the rotation axis of the supply roller relative to the support surface, between an initial position and a pivoted position, wherein the second axis of the stopper cam is located upstream of the rotation axis of the supply roller in the conveying direction and farther from the support surface than the rotation axis of the supply roller, wherein when the stopper cam is located at the third position, the inclined surface is located at the initial position and out of contact with the plurality of sheets stopped by the stopper located at the first position, and wherein when the stopper cam pivots from the third position toward the fourth position, the inclined surface is pushed toward the pivoted position by the plurality of sheets released from the stopper.

2. The sheet conveying apparatus according to claim 1, wherein the supplier further comprises a pressing member that faces the support surface and the supply roller.

3. The sheet conveying apparatus according to claim 1, wherein the supplier comprises a plurality of supply rollers each as the supply roller, and wherein the plurality of supply rollers are arranged at different positions in the conveying direction and arranged in a plurality of rows in the direction in which the rotation axis extends.

4. A sheet conveying apparatus comprising:

a supporter comprising a support surface configured to support a plurality of sheets;

a supplier comprising a supply roller rotatable about a rotation axis, the supply roller comprising an outer circumferential surface partly exposed from the support surface and configured to supply one or more sheets supported by the support surface toward a downstream side in a conveying direction along a conveyance path by rotating in contact with the one or more sheets supported by the support surface in a direction for supplying the one or more sheets in the conveying direction;

a separator disposed downstream of the supplier in the conveying direction and configured to separate one by one the one or more sheets supplied by the supplier and convey the separated sheet toward the downstream side in the conveying direction;

a stopper disposed upstream of the separator in the conveying direction and pivotable about a first axis that is located opposite to the rotation axis of the supply roller relative to the support surface, the stopper being movable between (i) a first position at which a distal end portion of the stopper extends to the support surface and intersects the conveyance path to restrict movement of leading edges of the plurality of sheets supported by the support surface and (ii) a second position at which the distal end portion is separated from the support surface and is located more downstream in the conveying direction than at the first position; and a stopper cam disposed upstream of the separator in the conveying direction and pivotable about a second axis that is located opposite to the first axis relative to the support surface, the stopper cam being movable between (a) a third position at which the stopper cam contacts the distal end portion of the stopper located at the first position from a downstream side in the conveying direction to restrict movement of the stopper toward the second position and (b) a fourth position at which the stopper cam is spaced apart from the distal end portion of the stopper to allow movement of the stopper from the first position toward the second position, wherein the second axis is located upstream of the rotation axis of the supply roller in the conveying direction and farther from the support surface than the rotation axis, wherein the stopper cam comprises a first portion extending from the second axis in the conveying direction, and a second portion contactable with the distal end portion of the stopper, wherein the first portion is located farther from the support surface than the rotation axis of the supply roller is from the support surface, wherein the supply roller is supported by a rotation shaft defining the rotation axis, and wherein the second portion of the stopper cam defines therein a cutout recessed so as to avoid the rotation shaft.

5. The sheet conveying apparatus according to claim 1, wherein the supporter further comprises a surface opposite to the support surface and a restrictor facing the surface opposite to the support surface, and wherein the stopper cam is situated at the fourth position by contact of the first portion with the restrictor.

6. The sheet conveying apparatus according to claim 1, further comprising:

a motor configured to rotate in a first direction to drive the separator and configured to rotate in a second direction reverse to the first direction to drive the stopper cam via a one-way clutch; and an urging member configured to urge the stopper cam toward the fourth position, wherein rotation of the motor in the second direction establishes a connected state of the one-way clutch to move the stopper cam to the third position, and rotation of the motor in the first direction establishes a disconnected state of the one-way clutch to move the stopper cam to the fourth position by an urging force of the urging member.

7. The sheet conveying apparatus according to claim 1, wherein the separator comprises a separating roller and a retard roller, wherein the support surface defines a portion of the conveyance path and extends to a position located downstream of the separator in the conveying direction, wherein the separating roller is rotatable about a third axis that is located opposite to the first axis of the stopper relative to the support surface, wherein the retard roller is rotatable about a fourth axis that is located opposite to the third axis of the separating roller relative to the support surface, and the retard roller comprises a torque limiter, wherein when the supplier supplies a single sheet, the retard roller is rotated by rotation of the separating roller to convey the single sheet in the conveying direction, and wherein when the supplier supplies two or more sheets, the retard roller is not rotated to apply a separating force to sheets other than a sheet contacting the separating roller, and the separating force acts in a direction opposite to the conveying direction.

8. The sheet conveying apparatus according to claim 1, wherein a pair of the stopper and the stopper cam is disposed on each of opposite sides of the separator in a direction in which the rotation axis of the supply roller extends.

9. The sheet conveying apparatus according to claim 1, wherein the stopper cam comprises a first portion through which the second axis passes, and a second portion having the contact surface, the first portion of the stopper cam at the third position extending parallel to the support surface, and the second portion of the stopper cam at the third position being located, in the conveying direction, downstream of the rotation axis of the supply roller and upstream of an entirety of the separator.

* * * * *